US010137469B2

(12) United States Patent
Guo et al.

(10) Patent No.: US 10,137,469 B2
(45) Date of Patent: Nov. 27, 2018

(54) COATING DEVICE AND WASHING METHOD FOR ITS NOZZLE

(71) Applicants: BOE TECHNOLOGY GROUP CO., LTD., Beijing (CN); BEIJING BOE DISPLAY TECHNOLOGY CO., LTD., Beijing (CN)

(72) Inventors: Yangchen Guo, Beijing (CN); Pengyu Qi, Beijing (CN)

(73) Assignees: BOE Technology Group Co., Ltd., Beijing (CN); Beijing BOE Display Technology Co., Ltd., Beijing (CN)

( * ) Notice: Subject to any disclaimer, the term of this patent is extended or adjusted under 35 U.S.C. 154(b) by 0 days.

(21) Appl. No.: 15/255,426

(22) Filed: Sep. 2, 2016

(65) Prior Publication Data

US 2017/0120306 A1 May 4, 2017

(30) Foreign Application Priority Data

Oct. 30, 2015 (CN) ..... 2015 1 0728745

(51) Int. Cl.

| | |
|---|---|
| ***B08B 3/02*** | (2006.01) |
| ***B05B 15/555*** | (2018.01) |
| ***B05B 7/24*** | (2006.01) |
| ***B05B 12/02*** | (2006.01) |
| ***B08B 3/04*** | (2006.01) |
| ***B08B 5/02*** | (2006.01) |
| ***B05B 14/00*** | (2018.01) |

(52) U.S. Cl.

CPC ..... *B05B 15/555* (2018.02); *B05B 7/24* (2013.01); *B05B 12/02* (2013.01); *B05B 14/00* (2018.02); *B08B 3/02* (2013.01); *B08B 3/04* (2013.01); *B08B 5/02* (2013.01)

(58) Field of Classification Search

CPC ..... B05B 15/02

See application file for complete search history.

(56) References Cited

FOREIGN PATENT DOCUMENTS

| | | |
|---|---|---|
| JP | 2007-237122 | * 9/2007 |
| JP | 2007-294907 | * 11/2007 |

OTHER PUBLICATIONS

Machine translation of JP2007-294907 by Kitamura et al., published Nov. 8, 2007.*

Machine translation of JP2007-237122 by Kajima et al., published Sep. 20, 2007.*

* cited by examiner

*Primary Examiner* — Douglas Lee

*Assistant Examiner* — Ryan L. Coleman

(74) *Attorney, Agent, or Firm* — Collard & Roe, P.C.

(57) ABSTRACT

A coating device and a washing method for its nozzle are provided. The coating device including a barrel, a nozzle connected with the barrel, and a waste sump provided below the nozzle, wherein the coating device further includes a washing bath and a washing component, the washing bath is provided at a side of the waste sump, and the washing component is provided in the washing bath, and is configured to inject washing liquid and cleaning gas to the nozzle to wash the nozzle when the nozzle is moved to the top of the washing bath.

7 Claims, 2 Drawing Sheets

COATING DEVICE AND WASHING METHOD FOR ITS NOZZLE

CROSS REFERENCE TO RELATED APPLICATIONS

Applicant claims priority under 35 U.S.C. § 119 of Chinese Application No. 201510728745.4 filed on Oct. 30, 2015, the disclosure of which is incorporated by reference.

TECHNICAL FIELD

The present disclosure relates to a coating device and a washing method for its nozzle.

BACKGROUND

Before a coater is used to coat photoresist every time, it need to be cleaned by a rubber to clean off photoresist remained at its nozzle, to guarantee quality for next coating.

However, since the nozzle of the coater has a extended length, the rubber cannot reach vicinity of a bottom end of the nozzle, there would be problems as follows: the photoresist remained at the bottom end of the nozzle cannot be cleaned in time, by accumulating overtime, it will condense to become photoresist blocks, the condensed photoresist blocks will become dry and tend to drop off after a relative long time, and if the blocks drop on a surface of a substrate which is being coated, the coating quality will be degraded.

SUMMARY

An embodiment of the disclosure provides a coating device including a barrel, a nozzle connected with the barrel, and a waste sump provided below the nozzle, wherein the coating device further includes a washing bath and a washing component, the washing bath is provided at a side of the waste sump, and the washing component is provided in the washing bath, and is configured to inject washing liquid and cleaning gas to the nozzle to wash the nozzle when the nozzle is moved to the top of the washing bath.

In some examples, the washing component includes a fork shaped bracket with two fingers, the two fingers are both provided with liquid outlets and gas outlets at ends thereof, the liquid outlets are configured to inject dilute liquid and the gas outlets are configured to inject the cleaning gas.

In some examples, the washing bath is provided with a guide rail therein, the guide rail is extended in a same direction as the washing bath, the fork shaped bracket is connected with the guide rail by a connection component, and the connection component is configured so that the fork shaped bracket is reciprocated along the guide rail.

In some examples, the connection component is configured so that the fork shaped bracket is capable of rotating from a state parallel with the guide rail to a state perpendicular to the guide rail.

In some examples, the two fingers of the fork shaped bracket are spaced by a distance larger than a maximum width of a cross section of the nozzle.

In some examples, when the nozzle is located above the fork shaped bracket and the fork shaped bracket is in the state perpendicular to the guide rail, the two fingers of the fork shaped bracket are spaced from both sides of the nozzle by a distance of 3 to 7 mm.

In some examples, the connection component is a running transmission shaft.

In some examples, the washing bath is extended in a direction parallel with a direction in which the waste sump is extended.

In some examples, the liquid outlets and the gas outlets are provided in sidewalls of the two fingers opposing to each other.

An embodiment of the disclosure provides a method for washing the nozzle of the coating device as mentioned above, including: moving the nozzle to the top of the washing bath; and controlling the washing component to inject washing liquid and cleaning gas to the nozzle to wash the nozzle.

In some examples, the washing component includes a fork shaped bracket with two fingers, and the two fingers are both provided with liquid outlets and gas outlets at ends thereof; controlling the washing component to inject washing liquid and cleaning gas to the nozzle to wash the nozzle includes: controlling a connection component of the washing component so that the nozzle is located between the two fingers of the fork shaped bracket, firstly injecting dilute liquid to the nozzle by the liquid outlets on the fingers of the fork shaped bracket, and then injecting cleaning gas to the nozzle by the gas outlets on the fingers of the fork shaped bracket.

In some examples, the washing bath is further provided with a guide rail, the guide rail is extended in a same direction as the washing bath, and the fork shaped bracket is connected with the guide rail by the connection component; controlling the connection component of the washing component so that the nozzle is located between the two fingers of the fork shaped bracket includes: bring the fork shaped bracket of the washing component to rotate from a state parallel with the guide rail to a state perpendicular to the guide rail and to reciprocate along the guide rail.

In some examples, upon the liquid outlets injecting the dilute liquid to the nozzle, the fork shaped bracket is moved on the guide rail at a speed of 100 to 200 mm/s.

In some examples, upon the gas outlets injecting the cleaning gas to the nozzle, the fork shaped bracket is moved on the guide rail at a speed of 50 to 100 mm/s.

BRIEF DESCRIPTION OF THE DRAWINGS

In order to more clearly describe the technical solution of the embodiments of the present invention, the attached drawings for the embodiments will be briefly described, it is obvious that the attached drawings in the following description only illustrate some embodiments of the present invention, but not are intended to limit the present invention.

DETAILED DESCRIPTION

In order to make objects, technical details and advantages of the embodiments of the invention apparent, the technical solutions of the embodiments will be described in a clearly and fully understandable way in connection with the drawings related to the embodiments of the invention. Apparently, the described embodiments are just a part but not all of the embodiments of the invention. Based on the described embodiments herein, those skilled in the art can obtain other embodiment(s), without any inventive work, which should be within the scope of the invention.

Figure 1:
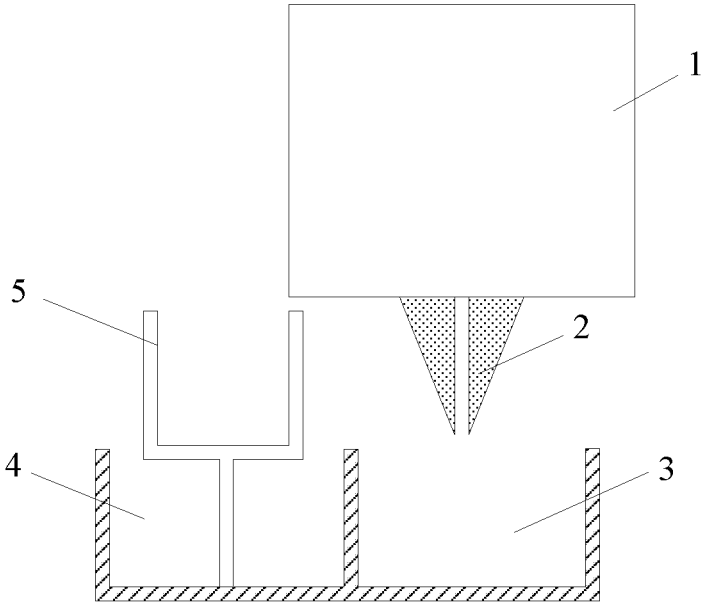
FIG. 1 is a schematic view illustrating structure of a coating device provided by an embodiment of the present disclosure.

Referring to FIG. 1, an embodiment of the present disclosure provides a coating device including a barrel 1, a nozzle 2 connected with the barrel 1, and a waste sump 3 disposed below the nozzle 2. In the present embodiment, the barrel 1 and the nozzle 2 can be connected in various of connection ways, for example, can be connected through a pipe, the barrel 1 can also be fixedly connected with the nozzle. In fact, the barrel 1 can be substituted with a cavity having receiving function so that the cavity is communicated with the nozzle and collectively used as a coating head of the coating device. Therefore, many variations can be made within the spirit of the present disclosure, and should all fall within the protection scope of the present disclosure.

The coating device further includes a washing bath 4 and a washing component 5. The washing bath 4 is provided at a side of the waste sump 3, and the washing component 5 is provided in the washing bath 4. When the nozzle 2 is moved to top of the washing bath 4, the washing component 5 is used to inject washing liquid and cleaning gas to the nozzle 2 so as to wash the nozzle 2.

In the present embodiment, by providing the washing bath at a side of the waste sump 3 and providing the washing component 5 in the washing bath, the nozzle 2 moved to the top of the washing bath can be washed by the washing component 5 so as to ensure cleanness of the nozzle 2, and the phenomenon that condensed photoresist blocks are formed at a bottom end of the nozzle 2 and the condensed photoresist blocks drop on a surface of a substrate under coating so as to affect the coating quality can be avoided. At the same time, the liquid generated during the cleaning directly enters into the washing bath, and will not contaminate the photoresist in the waste sump 3.

As necessary, the washing component 5 may have unilateral washing ability so as to only wash one side of the nozzle 2, or may also have bilateral washing ability to wash both sides of the nozzle 2. Of course, considering washing effect and efficiency, the washing component 5 may have bilateral washing ability.

In some examples, the washing component 5 includes a fork shaped bracket 50 with two fingers, at ends of the two fingers, both a liquid outlet 51 and a gas outlet 52 are provided. The liquid outlet 51 is used to inject dilute liquid, and the gas outlet is used to inject cleaning gas. It is to be noted that in the fork shaped bracket 50, pipes (not illustrated) respectively connected with the liquid outlet 51 and the gas outlet 52 are provided so as to provide the dilute liquid to the liquid outlet 51 and provide the cleaning gas to the gas outlet. In the present embodiment, the two fingers of the fork shaped bracket 50 of the washing component are provided with liquid outlets 51 so as to wash both sides of the nozzle 2, and can achieve better washing effect.

For example, the liquid outlets 51 and the gas outlets 52 on the two fingers are respectively located in side walls of the two fingers opposing to each other. Thus, when the nozzle 2 is positioned between the two fingers, it can be washed by the liquid injected from the liquid outlets 51 and the gas injected from the gas outlets 52.

Figure 2:
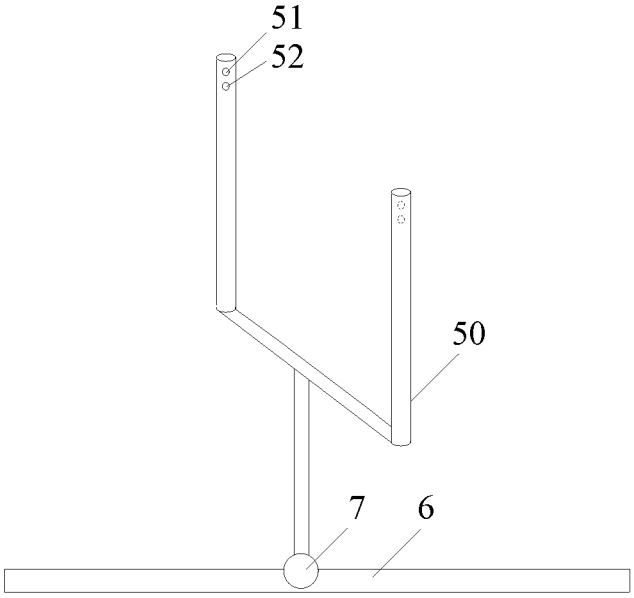
FIG. 2 is a schematic diagram illustrating structure of a washing component fitted with a guide rail as provided by an embodiment of the present disclosure.

The nozzle 2 of the coating device is placed above the waste sump 3 to avoid the uncondensed photoresist remained at the nozzle 2 from dropping outside of the waste sump 3. Therefore, normally, the nozzle 2 of the coating device is moved in a direction designed according to the coating process, and cannot be arbitrarily moved, but the nozzle 2 for coating the photoresist has a relative broad width, thus in order to better clean the nozzle 2, the washing component 5 can be designed to have moving function. Referring to FIG. 2, for example, a guide rail 6 is further provide in the washing bath 4, the guide rail 6 is extended in a same direction as the washing bath 4, and the fork shaped bracket 50 is connected with the guide rail 6 by a connection component 7. The fork shaped bracket 50 can be rotated from a horizontal placement state to a vertical placement state by means of the connection component 7 and can be reciprocate on the guide rail 6 by means of the connection component 7. For example, as used herein, the horizontal placement state refers to a state in which the fork shaped bracket 50 is parallel with the guide rail, and the vertical placement state refers to a state in which the fork shaped bracket 50 is perpendicular to the guide rail. It should be appreciated that the fork shaped bracket 50 not only has the two states, i.e. the horizontal placement state and the vertical placement state, but in fact, the fork shaped brackets 50 can be rotated by means of the connection component 7 to achieve a placement state at an arbitrary angle between the horizontal placement state and the vertical placement state. In the present embodiment, the fork shaped bracket 50 can be reciprocated on the guide rail 6, so as to repeatedly wash both sides of the nozzle 2.

In order to avoid collision between the fork shaped bracket 50 and the nozzle 2 during the ascend and descend of the fork shaped bracket and provide better washing effect, for example, distance between the two fingers of the fork shaped bracket 50 is larger than a maximum width of a cross section of the nozzle 2.

In some examples, the nozzle 2 is placed above the fork shaped bracket 50, and when the fork shaped bracket 50 is in the vertical placement state, the two fingers of the fork shaped bracket 50 is respectively spaced from both sides of the nozzle 2 by a distance of 3 to 7 mm.

In some examples, the connection component 7 is a running transmission shaft.

In some examples, the washing bath 4 is extended in a same direction of the waste sump 3.

The embodiment of the present disclosure has the following benefit: by providing the washing bath at a side of the waste sump and providing the washing component in the washing bath, the nozzle moved to the top of the washing bath can be washed by the washing component, so that the cleanness of the nozzle can be guaranteed and the phenomenon that condensed photoresist is formed at the bottom end of the nozzle and the condensed photoresist drops on the surface of the substrate under coating and hence the coating quality is affected can be avoided. At the same time, the liquid generated during the washing process directly flows into the washing bath, and would not contaminate the photoresist in the waste sump.

Figure 3:
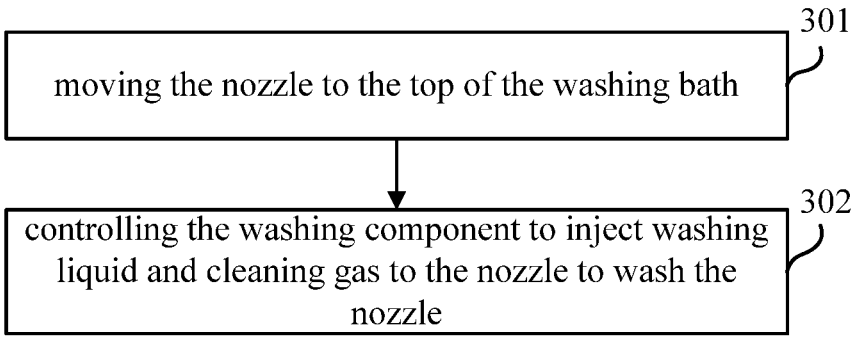
FIG. 3 is a flowchart view illustrating a cleaning method for a nozzle of a coating device as provided by an embodiment of the present disclosure.

Referring to FIG. 3, an embodiment of the present disclosure provides a washing method for a nozzle of a coating device, including:

301: moving the nozzle to the top of a washing bath; and

302: controlling a washing component to inject washing liquid and cleaning gas to the nozzle so as to wash the nozzle.

The above step 302 for example includes: by controlling a connection component of the washing component, bringing a fork shaped bracket of the washing component to rotate from a horizontal placement state to a vertical placement state and reciprocate on a guide rail of the washing component, injecting dilute liquid to the nozzle by liquid outlets on fingers of the fork shaped bracket, and then injecting cleaning gas to the nozzle by gas outlets on the fingers of the fork shaped brackets. For example, by controlling the connection component of the washing component, the nozzle can be placed between the two fingers of the fork shaped bracket, so that the nozzle can be washed.

In order to achieve good washing effect while the fork shaped bracket is moved on the guide rail, for example, when the dilute liquid is injected to the nozzle by the liquid outlets, the fork shaped bracket is moved on the guide rail at a speed of 100 to 200 mm/s.

In order to achieve good gas drying effect while the fork shaped bracket is moved on the guide rail, for example, when the cleaning gas is injected to the nozzle by the gas outlets, the fork shaped bracket is moved on the guide rail at a speed of 50 to 100 mm/s.

The embodiment of the present disclosure has the following benefit: by providing the washing bath at a side of the waste sump and providing the washing component in the washing bath, the nozzle moved to the top of the washing bath can be washed by means of the washing component, so that the cleanness of the nozzle can be guaranteed and the phenomenon that condensed photoresist is formed at the bottom end of the nozzle and the condensed photoresist drops on the surface of the substrate under coating and hence the coating quality is affected can be avoided. At the same time, the liquid generated during the washing process directly flows into the washing bath, and would not contaminate the photoresist in the waste sump.

What has been described above is only the exemplary embodiment of the present invention, and is not used to limit the protection scope of the present invention, which is only defined by the appending claims.

The present application claims the priority of a Chinese Patent Application No. 201510728745.4, filed on Oct. 30, 2015, the disclosure of which is entirely incorporated herein by reference as a part of the present disclosure.

The invention claimed is:

1. A coating device comprising a barrel, a nozzle connected with the barrel, a waste sump and a washing bath and a washing component, wherein:

the washing bath is provided at a side of the waste sump, and the nozzle is configured such that it can be positioned above the washing bath or the waste sump;

the washing component is provided in the washing bath, and is configured to discharge washing liquid and cleaning gas to the nozzle to wash the nozzle when the nozzle is moved to a position above the washing bath;

the washing component comprises a fork shaped bracket with two fingers, wherein the two fingers are provided with liquid outlets and gas outlets at ends thereof, wherein the liquid outlets are configured to discharge dilute liquid, and wherein the gas outlets are configured to discharge the cleaning gas; and wherein the washing bath is provided with a guide rail therein, the guide rail is extended in a same direction as the washing bath, the fork shaped bracket is connected with the guide rail by a connection component, and the connection component is configured so that the fork shaped bracket is reciprocated along the guide rail.

2. The coating device according to claim 1, wherein the connection component is configured so that the fork shaped bracket is capable of rotating from a state parallel with the guide rail to a state perpendicular to the guide rail.

3. The coating device according to claim 1, wherein the two fingers of the fork shaped bracket are spaced by a distance larger than a maximum width of a cross section of the nozzle.

4. The coating device according to claim 2, wherein when the nozzle is located above the fork shaped bracket and the fork shaped bracket is in the state perpendicular to the guide rail, the two fingers of the fork shaped bracket are spaced from both sides of the nozzle by a distance of 3 to 7 mm.

5. The coating device according to claim 1, wherein the connection component is a running transmission shaft.

6. The coating device according to claim 1, wherein the washing bath is extended in a direction parallel with a direction in which the waste sump is extended.

7. The coating device according to claim 1, wherein the liquid outlets and the gas outlets are provided in sidewalls of the two fingers.

* * * * *